US005562279A

United States Patent [19]

Gillieron

[11] Patent Number: 5,562,279

[45] Date of Patent: Oct. 8, 1996

[54] COMBINATION GRIPPER BAR AND DEVICE FOR FASTENING THE GRIPPER BAR ON A CHAIN TRAIN IN A MACHINE FOR PROCESSING PLATE-LIKE WORKPIECES

[75] Inventor: Jean-Luc Gillieron, Lausanne, Switzerland

[73] Assignee: Bobst SA, Lausanne, Switzerland

[21] Appl. No.: 432,642

[22] Filed: May 3, 1995

[30] Foreign Application Priority Data

May 4, 1994 [CH] Switzerland ..... 01397/94

[51] Int. Cl.[6] ..... B65H 29/04

[52] U.S. Cl. ..... 271/204; 198/473.1

[58] Field of Search ..... 271/277, 204–206; 198/731, 473.1, 817

[56] References Cited

U.S. PATENT DOCUMENTS

| | | | |
|---|---|---|---|
| 2,954,864 | 10/1960 | Lee et al. | 198/731 |
| 3,089,579 | 5/1963 | Beck | 198/731 |
| 3,809,390 | 5/1974 | Lenoir | 271/204 |
| 4,693,362 | 9/1987 | Kemmerer et al. | 271/277 |
| 5,000,310 | 3/1991 | Edmondson | 198/731 |
| 5,125,640 | 6/1992 | Yerly et al. . | |

FOREIGN PATENT DOCUMENTS

| | | | |
|---|---|---|---|
| 0448943 | 10/1991 | European Pat. Off. . | |
| 565088 | 1/1924 | France . | |
| 1094423 | 5/1955 | France | 198/731 |
| 304032 | 1/1928 | United Kingdom . | |
| 574187 | 12/1945 | United Kingdom | 198/731 |

*Primary Examiner*—H. Grant Skaggs
*Attorney, Agent, or Firm*—Hill, Steadman & Simpson

[57] ABSTRACT

A combination of a bar and a pair of fastening devices, which are integrated into a chain and replace a link of the chain on each end of the bar, includes an outer vertical plate portion and an inner vertical plate portion interconnected by an inner connection to form spaces for receiving an upstream axle and a downstream axle of the chain links, each axle being eventually covered by a meshing cylinder. The bar has a finger protruding from each end. The inner plate portion is completed on its inner face by a pair of spaced knuckles which receive a portion of the bar therebetween and are connected to the bar by a crosswise linking axle extending between the two knuckles and through the bar. The outer and inner plate portions each have an aperture for receiving the rigid finger which extends from the end of the bar.

5 Claims, 2 Drawing Sheets

COMBINATION GRIPPER BAR AND DEVICE FOR FASTENING THE GRIPPER BAR ON A CHAIN TRAIN IN A MACHINE FOR PROCESSING PLATE-LIKE WORKPIECES

BACKGROUND OF THE INVENTION

The present invention is directed to a combination of a gripper bar and a device for fastening the gripper bar at each end onto a chain train in a machine that processes plate-like workpieces, such as sheets of cardboard or sheets of paperboard.

A machine for processing sheet-like workpieces usually includes an infeed station in which a pile of the sheets is arranged, with every sheet being successively taken from the top of the pile in order to be carried onto a feeding table. On the feeding table, every sheet is positioned against front lays and side-marks before a front edge of the sheet is seized by a series of grippers fitted along a crosswise bar, whose ends are fastened into a train of lateral continuous chains which carry the bar and also the sheet into the next processing stations. The processing stations can include a die-cutting press, which is usually followed by a waste stripping station. These processing stations are followed by a delivery station in which every sheet is released by the grippers and is aligned prior to being dropped on top of an outlet pile.

The device for fastening the gripper bars onto the two trains of lateral continuous chains, which chains form a loop that passes around a driving chain wheel and a driven chain wheel, has to be very solid in order to transmit to the bars and, hence, to the sheet, the acceleration and deceleration forces which appear in the course of an intermittent run at high speed throughout the successive stations. Moreover, the crosswise bars, which support the grippers, are usually made out of rather complex profiled pieces in order to remain rigid to flexing and bending, which fact complicates the construction of the fastening device even more.

Moreover, the fastening device must allow a certain slack, i.e., a limited movement of the bar with regard to the chain trains in the sheet travelling direction so as to permit, by complementary means, an ultimate adjustment of the position of the sheet independent from the chain standstill position in a processing station. On the other hand, this fastening device is to remain rigid to rotation around the axle, which passes by the chain in order to limit, as much as possible, the flexing of the bar due to the centrifugal forces occurring during the movement of the chains and, particularly, when the chains pass around the driving and driven chain wheels arranged, respectively, at the beginning and the ending of the course of travel through the machine.

The known fastening devices usually include a first so-called fixed part, which is an integral part of the chain and is to replace a link, and a second so-called slack part, which is connected to the bar and slides in or on the first part of the fastening device in the sheet travelling direction against the effect of the elastic means, such as a spring. Moreover, one of the parts includes a finger extending parallel to the bar and sliding crosswise in the other part and this finger insures a rigidity of the fixture during the flexing of the bar in the course of the bar passing around the driving and driven chain wheels.

However, the respect given to the above-mentioned characteristics implies that the constitutive pieces of the actual devices be of a complex construction and therewith expensive. Moreover, the known fastening devices are different, depending whether they are designed for the left-hand side chain, which is the operator's side, or the right-hand side chain, which is opposite the operator's side, which fact compels the maintenance of a double stock of repair parts which are substantially symmetrical. In addition, the conception of the actual fastening device makes it impossible to dismantle the gripping bar for fixing or replacement without having to open the chain trains, which process of opening the chain trains is particularly difficult and fastidious operation. Finally, due to the complexity of these fastening devices, the areas for the ultimate position of adjustments are often located under the lower side, which fact, in the course of such adjustments, develops a clockwise rotational torque that tends to make the gripper look or rotate downward.

SUMMARY OF THE INVENTION

The object of the present invention is to provide a device for fastening a bar onto two trains of lateral continuous chains, which device is able to respect the characteristics of solidity, the slack and the control of centrifugal forces, though with a simple conception identical on both sides so as to diminish, in the same rate, the production costs. Moreover, such a device is combined with gripper bars, also of simple conception, and the device enables the gripper bars to be dismantled without opening the chain train.

The objects are achieved with a combination of a gripper bar and a pair of fastening devices which are an integral part of the chains and replaces a link of the chains and by the fact that the fastening device includes a vertical outer plate portion and a vertical inner plate portion, which are interconnected together and able to receive, between the two portions, an upstream axle and a downstream axle of the chain link, each axle being eventually covered by a meshing cylinder. The inner and outer plate portions have an aperture and the inner plate portion is completed on its inner face with a pair of knuckles, between whose branches a crosswise linking axle is passed to connect an inserted bar, and the bar has a rigid finger which extends from each end of the bar and is received in the aperture of the plate portions.

In a preferred embodiment, the crosswise linking axle is part of the bar and can slide in the pair of knuckles of the fastening device against the action of the elastic means, such as a spring, which acts between a side of one knuckle and a head of the axle. The slacking of the bar is, thus, realized very simply with the advantage that the head of the axle, which may serve as a resting point, is located in a plane of the bar, which fact prevents any risk of tilting.

In a preferred embodiment, the fastening device is symmetrical about the vertical plane crossing the gripping bar, the inner and outer plate portions being linked by two connections located, in the median horizontal plane, on either side of the central aperture for the finger of the bar. Owing to this geometry, an identical fastening device can be used on the operator's side as much as on the side opposite the operator.

Advantageously, the gripper bar is simplified into a full-length bar extending in the middle of its two ends, respectively, and has a first width and a first thickness. The finger has a width which rates between one-third and two-thirds of the first width of the bar and a thickness almost equal to two-thirds of the first thickness of the bar.

Usefully, then, every gripper includes a lower jaw fitted on the upstream edge of the bar and an upper jaw having a shape of a flexible blade mounted on a downstream edge of the bar and passing above the upper face of the bar and protruding on each side of the lower jaw. The lower and upper jaws may specifically be fitted by a same bolt crossing the thickness of the bar. The opening of the gripper is then simply realized with a shiftable vertical comb, of which every tooth pushes a protruding part of the upper jaw. Moreover, the bar is held upward by one or several stops, such as rollers, which rest on bearings.

Other advantages and features of the invention will be readily apparent from the following description of the preferred embodiments, the drawings and claims.

DESCRIPTION OF THE PREFERRED EMBODIMENTS

Figure 1:
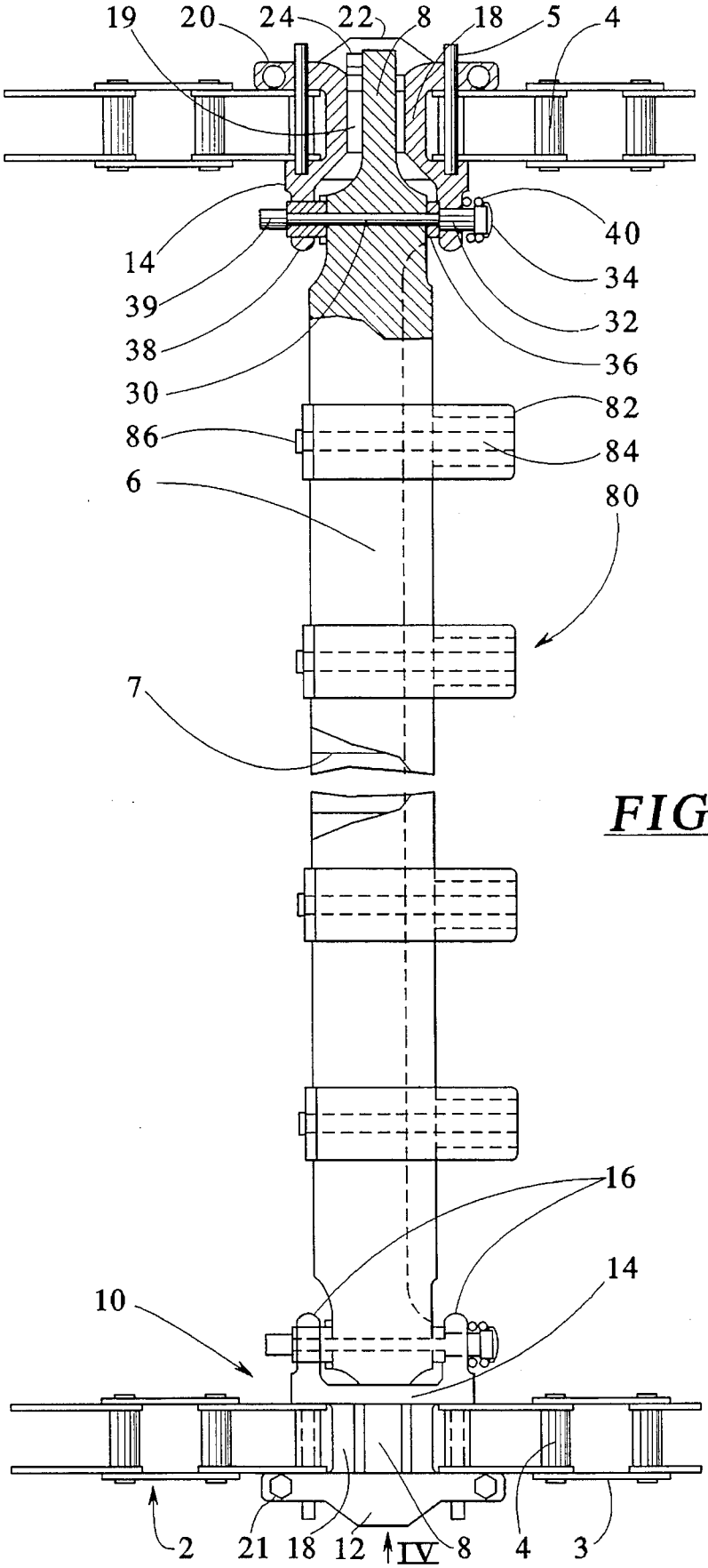
FIG. 1 is a top view of a combination of the bar and its fastening devices with portions broken away for purposes of illustration.
Figure 2:
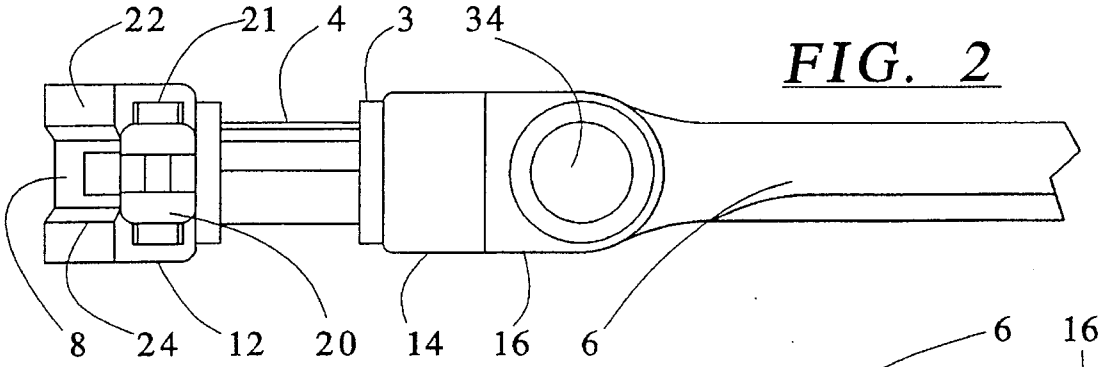
FIG. 2 is a side view of the fastening device of FIG. 1.

The principles of the present invention are particularly useful when incorporated in a combination of a gripper bar 6, which is linked at both ends by means of fastening devices 10 to a driving chain, which consists of a succession of links 2. Each link of the chain includes two lateral small plates 3 separated by meshing cylinders 4 and connected to the cylinders by an inner axle 50 (see FIG. 4).

A fastening device 10, which replaces one of the links 2, has a general shape of two vertical plates, with an outer vertical plate portion 12 and an inner plate portion 14 linked by interconnections 18. The upstream and downstream ends of these plates create two seats which receive, respectively, the last upstream and downstream link 2 of the chain.

More specifically, the inner vertical plate 14 is almost rectangular with a central aperture 19, and the inner plate portion 14 is completed on its inner face with a pair of knuckles 16 of which each downstream and upstream branch is machined with an opposite cylindrical orifice in order to receive an axle 30.

Figure 4:
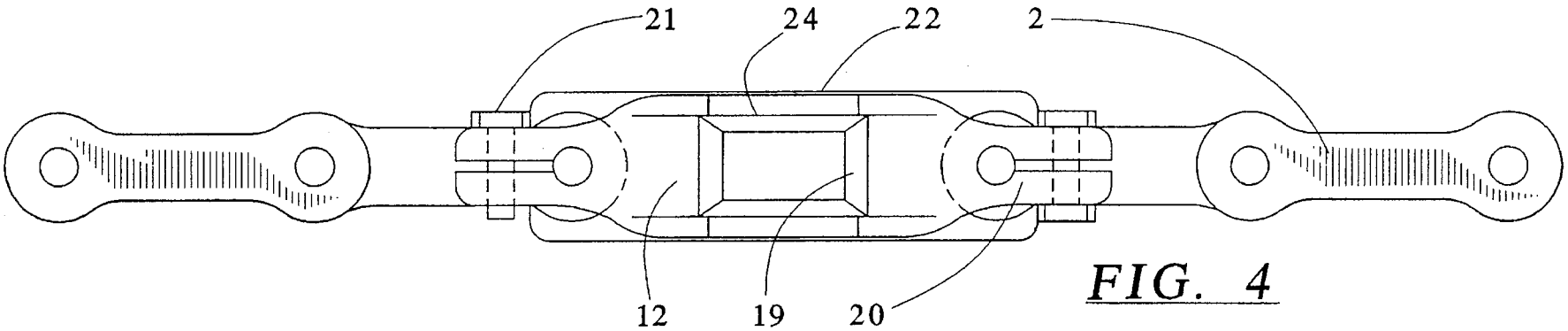
FIG. 4 is an end view of the fastening device taken in the direction of arrow IV of FIG. 1.

As may be better seen in FIG. 4, the outer plate portion 12 has the shape of two grippers 20 for holding the last axles 50 of the links 2 of the chain. These grippers are linked at the top and the bottom by two bridges 22 making also an aperture 19. Every gripper can be tightened by a bolt 21, and the faces of the bridges 22, which are oriented toward the aperture 19, are reinforced with resting pads 24.

As may be better visualized in FIGS. 1 and 4, the fastening device 10 is, on the one hand, symmetrical about a vertical plane crossing the bar 6 and, on the other hand, symmetrical around a horizontal plane crossing the middle of the chain of the links 2. It may be noticed in the upper part of FIG. 1 how the two connecting pieces 18 are arranged on either side of the aperture 19 of the chain plane. The same applies to the female knuckles 16.

Figure 3:
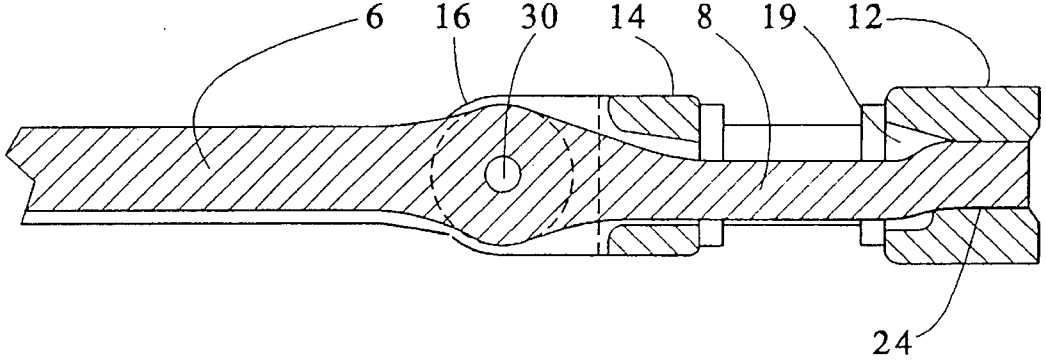
FIG. 3 is a vertical cross sectional view of the fastening device.

The bar 6, which is particularly compatible with the fastening device 10, has the shape of a full bar, whose ends are extended by a finger 8 of a width which lies between one-third and one-half the first or main width of the bar 6. The finger 8 has a thickness which, as illustrated in FIG. 3, is almost two-thirds of the first or main thickness of the bar 6.

As may be better visualized in FIG. 1, the fingers 8 of the bar 6 are engaged in the aperture 19 of their respective fastening device, and the bar is mounted to these fastening devices by means of a linking axle 30, which acts as a pin extending between the knuckles 16. This axle crosses the thickness of the bar. In a more precise way, the upstream end of the axle 30 has a bearing 32 which slides inside of its knuckle. This bearing ends with an enlarged head 34. The downstream end of the axle 30 is threaded so as to receive a nut 39, which allows for interlocking the axle and the bar between the upstream separating washer 36 and a downstream washer 38, which slides in the other branch of the knuckle 16. Moreover, a compression spring 40 is lodged between the upstream face of the knuckle and the head 34.

With this structure, the bar can effectuate a slight movement toward the left-hand side, such as illustrated in FIG. 1, this operation being achieved against the biasing force or compression of the spring 40. This movement or slack allows an ultimate adjustment of the position of the bar with regard to the chain with links 2 by direct action directly on the heads 34. It should be noticed that the pressure force necessary to move the bar toward the left develops rigorously in the chain plane and induces therewith no tilting of the bar along its lengthwise axle.

Associated along the full bar 6 of the invention, the grippers 80 include a lower jaw 84 inserted on an upstream edge of the bar and an upper jaw 82 having the shape of a flexible blade protruding on a downstream edge of the bar and being applied on the upper face of the bar and protruding on either side of the lower jaw 84. Advantageously, a same gripper bolt 86 extends through the thickness of the bar and allows for mounting the two jaws, the bolt head tightening the upper jaw against the downstream edge, the threaded part penetrating in a corresponding tapped orifice of the lower jaw.

The protruding parts of the upper jaws allow for a simple opening with a vertical push applied by the teeth of a subjacent comb. In order to avoid that the bar 6 bends upward during the opening of the grippers, a counter-reaction is foreseen, which concretize in the push of one or several upper rollers, especially in the area 7 on an upper face of the bar 6.

In case of wear or an important tear or breaking of the gripper bar, the latter can simply be taken out of the machine by removing the nuts 39 and taking out the linking axles 30 from the knuckles 16. One only needs to play with the lateral flexibility of the chain with links 2 in order to laterally separate the fastening device until the fingers 8 can be taken out of the aperture 19 one by one. This operation is much easier than the traditional opening of the chain by taking the axles 5 out of the fastening device 10.

On the other hand, as may be visualized in FIG. 3, the length of the finger 8, such as seized between the linking axle 30, which provides a pivot point when bending during the travel around the chain wheels at the end of the chain track, and the outer end of the finger, which is seized between the pads 24, allows to ensure an important counter-reaction to the centrifugal force which is applied to the bar.

Although various minor modifications may be suggested by those versed in the art, it should be understood that I wish to embody within the scope of the patent granted hereon all such modifications as reasonably and properly come within the scope of my contribution to the art.

I claim:

1. A combination of a bar with grippers and fastening devices on each end of the bar to integrate the bar into a chain, each fastening device including an outer vertical plate portion and an inner vertical plate portion being linked by an inner connection to form a member to replace a link in the chain and to receive between them an upstream axle and a downstream axle of the chain links, each axle being capable of being covered by a meshing cylinder, the outer and inner plate portions forming an aperture, the inner plate portion being provided on an inner face with a pair of knuckles, said bar having a rigid finger protruding from each end of the bar, a crosswise linking axle extending through the pair of knuckles and the bar interposed therebetween with the rigid finger extending into the aperture.

2. A combination according to claim 1, wherein the cross-linking axle extending through the bar can slide in the knuckles of the fastening device against the action of an elastic means which acts between a side of one knuckle and a head of the linking axle.

3. A combination according to claim 1, wherein the fastening device is symmetrical about the vertical plane crossing the gripping bar and inner and outer plate portions being linked by two portions of the inner connection located in a median horizontal plane on either side of the central aperture for the finger of the bar.

4. A combination according to claim 1, wherein the gripper bar is a full bar extending in the middle between its two ends with a first thickness and a first width, each of the fingers having a width lying between one-third and two-thirds the first width of the bar and a thickness almost equal to two-thirds of the first thickness of the bar.

5. A combination according to claim 4, wherein every gripper includes a lower gripper jaw mounted on an upstream edge of the bar and an upper gripper jaw having the shape of a flexible blade mounted on the downstream edge of the bar and extending above an upper face of the bar and protruding on each side of the lower jaw.

* * * * *